US008953817B2

(12) United States Patent
Mejia et al.

(10) Patent No.: US 8,953,817 B2
(45) Date of Patent: Feb. 10, 2015

(54) SYSTEM AND METHOD FOR PRODUCING A DIRECTIONAL OUTPUT SIGNAL

(75) Inventors: Jorge Patricio Mejia, Chatswood (AU); Harvey Albert Dillon, Chatswood (AU)

(73) Assignee: Hear IP Pty Ltd., Melbourne, Victoria (AU)

( * ) Notice: Subject to any disclaimer, the term of this patent is extended or adjusted under 35 U.S.C. 154(b) by 912 days.

(21) Appl. No.: 13/127,933

(22) PCT Filed: Dec. 1, 2009

(86) PCT No.: PCT/AU2009/001566

§ 371 (c)(1),
(2), (4) Date: Aug. 2, 2011

(87) PCT Pub. No.: WO2010/051606

PCT Pub. Date: May 14, 2010

(65) Prior Publication Data

US 2011/0293108 A1 Dec. 1, 2011

(30) Foreign Application Priority Data

Nov. 5, 2008 (AU) ..... 2008905703

(51) Int. Cl.
*H04R 3/00* (2006.01)
*H04R 25/00* (2006.01)
*H04R 5/033* (2006.01)

(52) U.S. Cl.
CPC ..... *H04R 25/407* (2013.01); *H04R 3/005* (2013.01); *H04R 5/033* (2013.01); *H04R 25/552* (2013.01); *H04R 2420/07* (2013.01); *H04R 2430/20* (2013.01); *H04S 2400/15* (2013.01); *H04S 2420/01* (2013.01)
USPC ..... 381/92; 381/23.1; 381/313

(58) Field of Classification Search
USPC ..... 381/92, 23.1, 313
See application file for complete search history.

(56) References Cited

U.S. PATENT DOCUMENTS

| | | | |
|---|---|---|---|
| 4,024,344 | A | 5/1977 | Dolby et al. |
| 5,434,924 | A | 7/1995 | Jampolsky |
| 6,222,927 | B1 | 4/2001 | Feng et al. |
| 2004/0057591 | A1 | 3/2004 | Beck et al. |
| 2005/0069162 | A1 | 3/2005 | Haykin et al. |
| 2005/0271215 | A1 | 12/2005 | Kulkarni |

FOREIGN PATENT DOCUMENTS

| | | |
|---|---|---|
| JP | 2002 0078100 | 3/2002 |
| WO | WO 2007/028250 | 3/2007 |
| WO | WO 2007/137364 | 12/2007 |

OTHER PUBLICATIONS

Supplementary European Search Report for EP 09 82 4292, dated Dec. 3, 2012. (2 pages).

*Primary Examiner* — Joseph Saunders, Jr.
(74) *Attorney, Agent, or Firm* — Merchant & Gould P.C.

(57) ABSTRACT

A system and method of producing a directional output signal is described including the steps of: detecting sounds at the left and rights sides of a person's head to produce left and right signals; determining the similarity of the signals; modifying the signals based on their similarity; and combining the modified left and right signals to produce an output signal.

10 Claims, 6 Drawing Sheets

SYSTEM AND METHOD FOR PRODUCING A DIRECTIONAL OUTPUT SIGNAL

This application is a National Stage Application of PCT/AU2009/001566, filed 1 Dec. 2009, which claims benefit of Serial No. 2008905703, filed 5 Nov. 2008 in Australia and which applications are incorporated herein by reference. To the extent appropriate, a claim of priority is made to each of the above disclosed applications.

TECHNICAL FIELD

The present invention relates to processing of sound signals and more particularly to bilateral beamformer strategies suitable for binaural assistive listening devices such as hearing aids, earmuffs and cochlear implants.

BACKGROUND TO THE INVENTION

When at least one microphone signal is available from each side of the head it is possible to optimally combine the microphone outputs to produce a super-directional response. Most well known binaural directional processors achieving a directional response are based on broadside array configurations, adaptive Least Minimum Square (LMS) or more sophisticated Blind Source Separation (BSS) strategies.

Broadside array configurations produce efficient directional responses when the wavelength of the sound sources is relatively larger than the spacing between microphones. As a result broadside array techniques are only effective for the low-frequency component of sounds when used in binaural array configurations.

Unlike broadside array designs Least Minimum Square (LMS) systems efficiently produce directionality independently of frequency or spacing between microphones. In such systems Voice Active Detectors (VAD) are needed to capture a desired signal during times where the ratio between signal level and noise level is relatively large. This captured desired signal, typically referred to as the estimated desired signal is compared to filtered outputs from the microphones, thus producing an estimated error signal. The objective of the LMS is to minimize the square of the estimated error signal by iteratively improving the filter weights applied to the microphone output signals. However, the estimated desired signal may not entirely reflect the real desired signal, and therefore the adaptation of the filter weights may not always minimize the true error of the system. The optimization largely depends on the efficiency of the VAD employed. Unfortunately, most VADs work well in relatively high signal-to-noise ratio environments but their performance significantly degrades as the signal-to-noise ratio decreases.

Blind Source Separation (BSS) schemes operate by efficiently computing a set of phase cancelling filters producing directional responses in all spatial locations where sound sources are present. As a result, the system produces as many outputs as there are sound sources present without specifically targeting a desired sound source. BSS schemes also require post-filtering algorithms in order to select an output with a desired target signal. The problems with BSS approaches are; the excessive computational overload required for efficiently computing phase cancelling filters, dependence of the filters on reverberation and on small movements of the source or listener, and the identification of the one output related to the target signal, which in most cases is unknown and the prior identification of the number of sound sources present in the environment to guarantee separation between sound sources.

There remains a need to provide improved or alternative methods and systems for producing directional output signals.

SUMMARY OF THE INVENTION

An alternative approach to binaural beamformer designs is to exploit the natural spatial acoustics of the head to directly use interaural time and level differences to produce directional responses. The interaural time difference, arising from the spacing between microphones on each side of the head (ranging from 18 to 28 cm), can be used to cancel relatively low frequency sounds, depending on the direction of arrival, as in a broadside array configuration. On the other hand, the head shadowing provides a natural level suppression of contralateral sounds (i.e. sounds presented from each side of the head), often leading to a much greater signal-to-noise ratio (SNR) in one ear than in the other. As a result the interaural level difference (ranging from 0 to 18 dB), can be used to cancel high frequency sounds depending on their direction of arrival in a weighted sum configuration. This low and high pass binaural beamformer topology is superior to conventional broadside array alone and LMS systems relying on VADs, and it is less computationally demanding than most BSS techniques. In addition, due to the novel design, the binaural beamformer operates in complex listening environments, e.g. low signal-to-noise ratios, and it provides rejection to such complex unwanted sounds as wind noise.

In a first aspect the present invention provides a method of producing a directional output signal including the steps of: detecting sounds at the left and rights sides of a person's head to produce left and right signals; determining the similarity of the signals; modifying the signals based on their similarity; and combining the modified left and right signals to produce an output signal.

The signals may be modified by attenuation and/or by time-shifting.

The attenuation and/or time-shifting may be frequency specific.

The attenuation and/or time-shifting may be carried out by way of a filter block and filter weights for the filter block are based on the similarity of the signals.

The step of determining the similarity of the signals may include the step of comparing their cross-power and auto-power, or comparing their cross-correlation and auto-correlation.

The step of comparing may include the steps of adding the cross-power to the auto-power and dividing the cross-power by the result.

The step of comparing may include the steps of adding the cross-correlation to the auto-correlation and dividing the cross-correlation by the result.

The method may further include the step of processing the right or left signals prior to determining their similarity to thereby control the direction of the directional output signal.

The step of processing may include the step of applying a head-related transfer function or an inverse head-related transfer function.

The step of detecting sounds at the left and right sides of the head may be carried out using directional microphones, or directional microphone arrays.

The direction of the left and right directional microphones or microphone arrays may be directed outwardly from the lateral plane of the head.

The degree of modification that takes place during the step of modifying may be smoothed over time.

The step of modifying may further include the step of further enhancing the similarities between the signals.

In a second aspect the present invention provides a system for producing a directional output signal including: detection devices for detecting sounds at the left and right sides of a person's head to produce left and right signals; a determination device determining the similarity of the signals; a modifying device for modifying the signals based on their similarity; and a combining device for combining the modified left and right signals to produce an output signal.

Each detection device may include at least one microphone.

The determination device may include a computing device.

The modifying device may include a filter block.

The combining device may include a summing block.

The system may further include a processing device for processing the left or right signals and wherein the processing device is arranged to apply one or more head-related transfer functions or inverse head-related transfer functions.

The present invention exploits the interaural time and level difference of spatially separated sound sources. The system operates in the low frequencies as an optimal broadside beamformer, a technique well known to those skilled in the art. In the high frequencies the system operates as an optimal weighted sum configuration where the weights are selected based on the relative placement of sounds around the head. In embodiments of the invention the optimum filter weights are computed by examining the ratio of the cross-correlation of microphone output signals from opposite sides of the head to the auto-correlation of microphone output signals from the same side of the head. Thus, at any frequency, when the cross-correlation is equal to the auto-correlation outputs it is highly likely that sound sources are equally present at both sides of the head, hence located near or close to the medial plane relative to the listeners head. On the other hand, when any of the auto-correlations is higher than the cross-correlation outputs it is highly likely that sound sources are located at the one side of the head. That is, laterally placed relative to the listeners head. The invention relates to a novel and efficient method of combining these correlation functions to estimate directional filter weights.

The circuit according to the invention is used in an acoustic system with at least one microphone located at each side of the head producing microphone output signals, a signal processing path to produce an output signal, and optional means to present this output signal to the auditory system. Preferably, the signal processing path includes a multichannel processing block to efficiently compute the optimum filter weights at different frequency bands, a summing block to combine the left and right microphone filtered outputs, and a post filtering block to produce an output signal.

The present invention finds application in methods and system for enhancing the intelligibility of sounds such as those described in International Patent Application No PCT/AU2007/000764 (WO2007/137364), the contents of which are herein incorporated by reference.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

The preferred embodiment of the invention is discussed below with reference to all figures. However, those skilled in the art will appreciate that the detailed description given herein with respect to all figures is for explanatory purpose as the invention extends beyond the limited disclosed embodiment.

Figure 1:
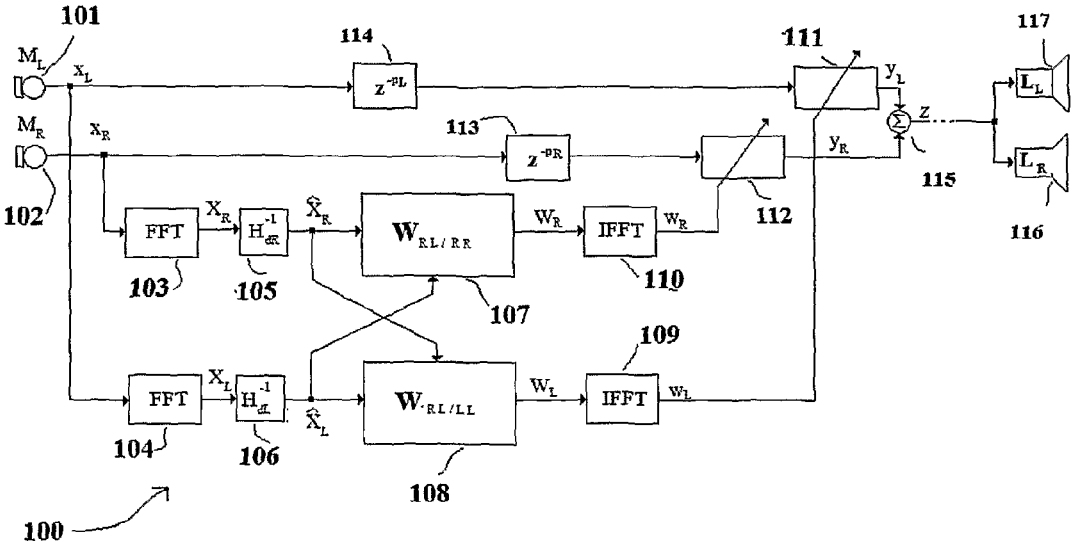
FIG. 1 is a block diagram of a system for producing a directional output signal according to an embodiment of the invention.

The binaural beamformer is intended to operate in complex acoustic environments. Referring to FIG. 1, the circuit 100 comprises of at least one detection device in the form of microphones 101, 102 located at each side of the head, a determination device in the form of processing block 107, 108 to compute directional filters weights, a modifying device in the form of filter block 111, 112 to filter the microphone outputs, a combining device in the form of summing block 115 to combine the filtered microphone outputs, and presentation means 117, 116 to present the combined output to the auditory system.

The microphone outputs $x_l$, $x_r$ are transformed into the frequency domain using Fast Fourier Transform (FFT) analysis 103, 104. Then these signals $X_L$,$X_R$ are processed through processing devices in the form of steering vector blocks 105, 106 to produce steered signals $\hat{X}_L$,$\hat{X}_R$ as denoted in Eq. 1. Steering vector blocks include the inverse of Head-related transfer Functions (HRTF) denoted as $H_{dL}^{-1}$,$H_{dR}^{-1}$ corresponding to either synthesized or pre-recorded impulse response measures from an equivalent desired point source location to the microphone input ports preferably located around the head, as further denoted in FIG. 2, 200.

$$\hat{X}_L(k)=X_L(k)\cdot H_{dL}^{-1}(k) \quad \text{Eq. 1}$$

$$\hat{X}_R(k)=X_R(k)\cdot H_{dR}^{-1}(k) \quad \text{Eq. 2}$$

The steered signals $\hat{X}_L$,$\hat{X}_R$ are combined 107, 108 to compute the optimum set of directional filter weights $W_L$,$W_R$. The computation of the filter weights requires estimates of cross-power Eq. 3 and auto-power Eq. 4-5 over time, where the accumulation operation is denoted by E{ }. It should be obvious to those skilled in the art that the ratios of accumulated spectra power estimates is equivalent to the ratio of time-correlation estimates, thus the alternative operations lead to the same outcome.

$$E\{\hat{X}_L(k)\cdot\hat{X}_R(k)\} = \sum_{m=k-N}^{k} \hat{X}_L(k,m)\cdot\hat{X}_R^*(k,m) \quad \text{Eq. 3}$$

$$E\{\hat{X}_R(k)\cdot\hat{X}_R(k)\} = \sum_{m=k-N}^{k} \hat{X}_R(k,m)\cdot\hat{X}_R^*(k,m) \quad \text{Eq. 4}$$

$$E\{\hat{X}_L(k)\cdot\hat{X}_L(k)\} = \sum_{m=k-N}^{k} \hat{X}_L(k,m)\cdot\hat{X}_L^*(k,m) \quad \text{Eq. 5}$$

where the accumulation is performed over N frames, and * denotes complex conjugate.

The directional filter weights are produced by calculating the ratio between the cross-over power and the auto-power estimates on each side of the head as given by Eq. 6 and Eq. 7

$$W_L(k) = \frac{\left|E\{\hat{X}_L(k)\cdot\hat{X}_R(k)\}\right|^g}{\left|E\{\hat{X}_L(k)\cdot\hat{X}_R(k)\}\right|^g + \left|E\{\hat{X}_L(k)\cdot\hat{X}_L^*(k)\}\right|^g} \quad \text{Eq. 6}$$

$$W_R(k) = \frac{\left|E\{\hat{X}_L(k)\cdot\hat{X}_R(k)\}\right|^g}{\left|E\{\hat{X}_L(k)\cdot\hat{X}_R(k)\}\right|^g + \left|E\{\hat{X}_R(k)\cdot\hat{X}_R^*(k)\}\right|^g} \quad \text{Eq. 7}$$

where the power g is a numerical value typically set to 1, but it can be any value greater or less than one.

Those skilled in the art will realise that the value of $\hat{X}_L$ relative to $\hat{X}_R$ and hence the values of $W_L(k)$ and $W_R(k)$ will be unchanged if processing block 105 consists of response $H_{dL}$ instead of $H_{dR}^{-1}$, and processing block 106 consists of response $H_{dR}$ instead of $H_{dL}^{-1}$.

A post-filtering stage (not shown) may be provided whereby the filter weights $W_L, W_R$ are enhanced according to Eq. 8 to Eq. 10

$$\Delta(k) = \eta|W_R(k) - W_L(k)| \quad \text{Eq. 8}$$

$$W_R^{new}(k) = \kappa\cdot\frac{W_R(k)}{1+\Delta(k)^q} \quad \text{Eq. 9}$$

$$W_L^{new}(k) = \kappa\cdot\frac{W_L(k)}{1+\Delta(k)^q} \quad \text{Eq. 10}$$

where η is a numerical value typically ranging from 1 to 100, q is a numerical value typically ranging from 1 to 10, and κ is a numerical value typically set to 2.0.

The optimum directional filter weights $W_L^{New}, W_R^{New}$ are transformed back to the time domain $w_L, w_R$ using Inverse Fast Fourier Transform blocks (IFFT) analysis 109, 110. Preferably, the FFT transform includes zero padding and cosine time windowing, and the IFFT operation further includes an overlap and adds operation. It should be obvious to those skilled in the art that the FFT and IFFT are just one of many different techniques that may be used to perform multi-channel analyses.

The computed filter weights $w_L, w_R$ can be updated 111, 112 by smoothing functions as given in Eq. 11 and Eq. 12. In the preferred embodiment the smoothing coefficient α is selected as an exponential averaging factor. Optionally, the smoothing coefficient α may be dynamically selected based on a cost function criterion derived from an estimated SNR or a statistical measure.

$$w_L(n)=\alpha\cdot w_L^{old}(n)+(1-\alpha)\cdot w_L^{new}(n) \quad \text{Eq. 11}$$

$$w_R(n)=\alpha\cdot w_R^{old}(n)+(1-\alpha)\cdot w_R^{new}(n) \quad \text{Eq. 12}$$

The directional filters are applied 111, 112 directly to the microphone outputs as given in Eq. 13 and Eq. 14. Optionally the direction filters may be applied to delayed microphone output signals. Optionally the delay blocks 113, 114 may use zero delay. Optionally 113 and 114 may used the same delay greater than zero. Optionally 113 and 114 may have different delays to account for asymmetrical placements of microphones on each side of the head. Optionally the directional filters may be applied to directional microphone output signals from directional microphone arrays operating at each side of the head. Optionally the directional filters may be applied to delayed directional microphone output signals from directional microphone arrays operating at each side of the head.

$$y_L(n)=x_L(n-pL)\otimes w_L(n) \quad \text{Eq 13}$$

$$y_R(n)=x_R(n-pR)\otimes w_R(n) \quad \text{Eq. 14}$$

where pL and pR are introduced delays, typically set to 0. The filtered outputs are combined 115 to produce a binaural directional response as given in Eq. 15.

$$z(n)=y_R(n)+y_L(n) \quad \text{Eq. 15}$$

Figure 2:
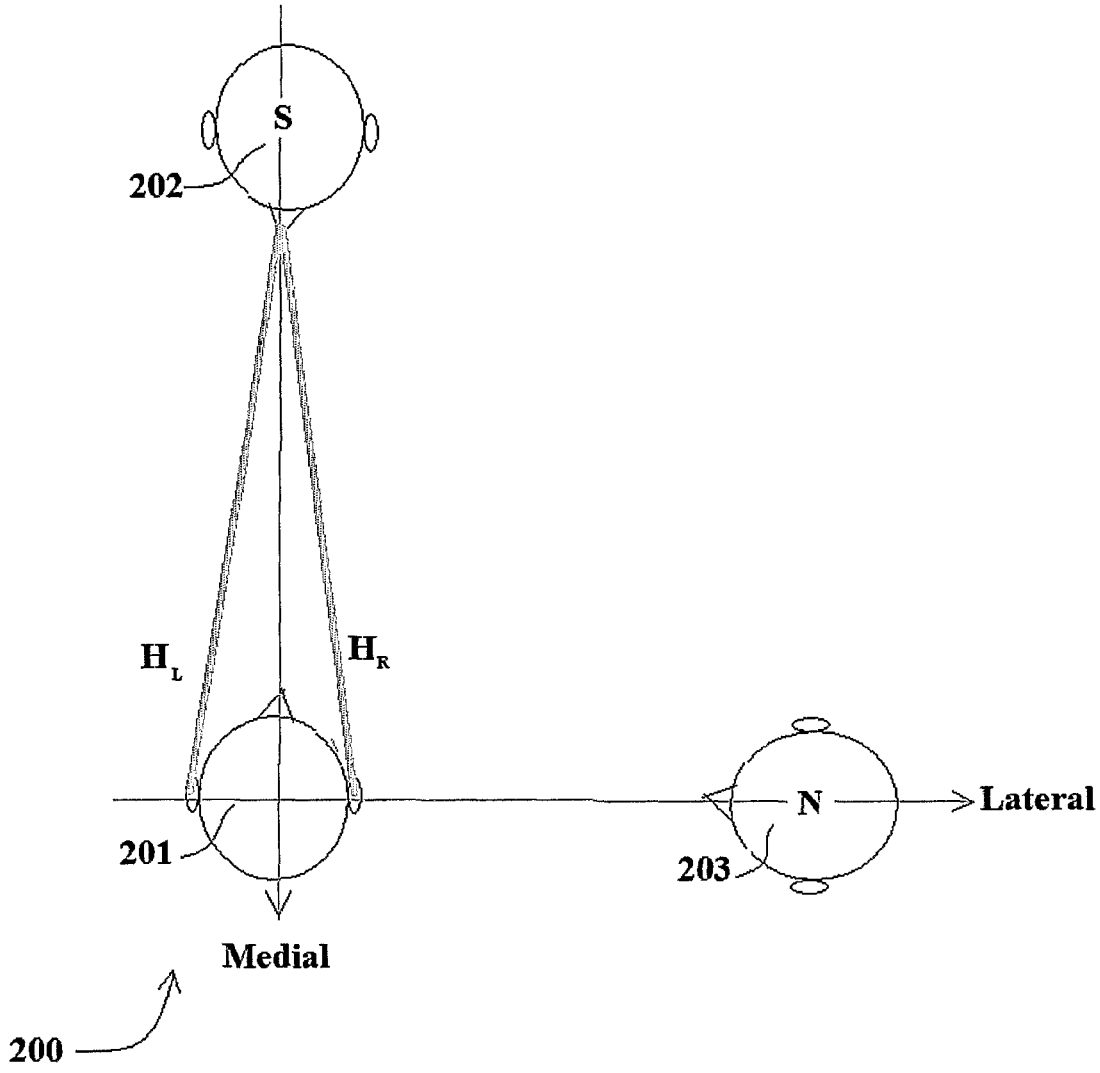
FIG. 2 is an illustration of the spatial representation of sounds sources.

Now referring to FIG. 2, 200, the illustration shows the HRTF response from a point source (S) 202, located in the medial plane, to microphone input ports located at each side of a listener's head 201. The figure further illustrates a competing sound source (N) 203 at the one side of the listener.

Referring to FIG. 2, sounds emanating from both sources, S and N, are detected at microphones positioned on either side of the head. It can be seen that, when sound is being produced by source N, the right hand microphone will record a stronger response from source N than the left microphone, whereas both microphones will record a similar response from source S. The result of this is that the auto-power value measured at the right hand microphone will be higher than the auto-power value measured at the left hand microphone. Thus, the filter weight calculated for the right hand microphone is lower than for the left hand microphone. By preferentially using information picked up from the left hand microphone, a more faithful reproduction of source S is ultimately achieved. The system can be thought of in terms of providing a simulated "better ear" advantage.

Figure 3:
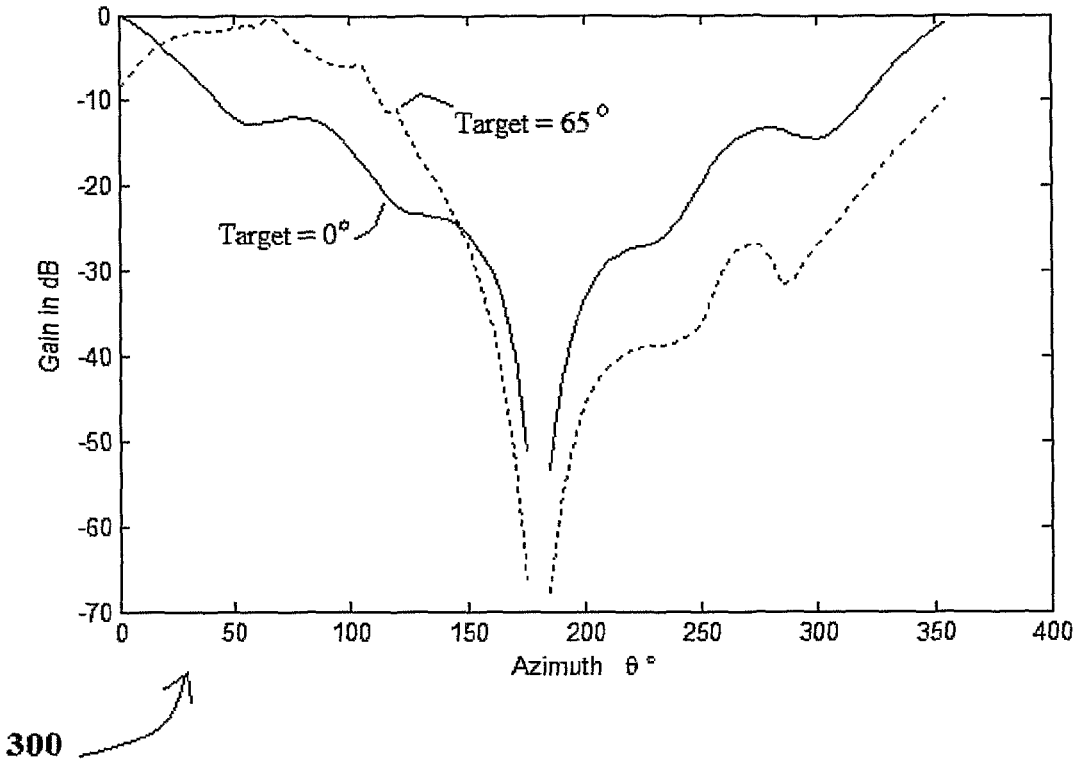
FIG. 3 is an example application of an embodiment of the invention.

Now referring to FIG. 3, 300, the figure shows directional responses produced by the novel binaural beamformer scheme when combined with $2^{nd}$ order directional microphone arrays operating independently at each side of the head and having forward cardioid responses. The figure shows the responses produced when the steering vector was set to 0° azimuth (solid-line) and to 65° azimuth (dashed-line).

Figure 4:
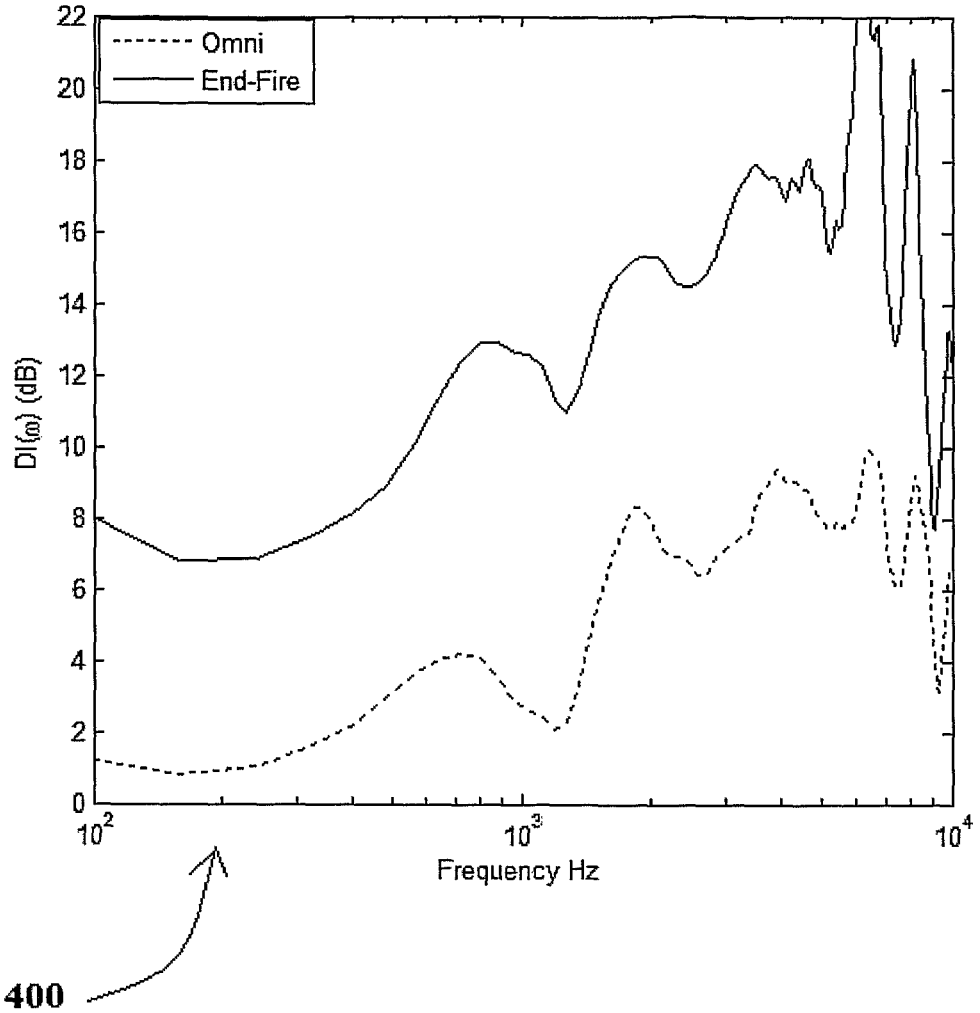
FIG. 4 is the two-dimensional measured directional responses produced by an embodiment of the invention.

Now referring to FIG. 4, 400, the figure shows the Two Dimensional Directivity Index (2×DI(ω)), here defined as the decibel value of the power of the acoustic beam directed to the front θ=0° divided by the averaged power produced in the rejection region θ≠0°, as shown in Eq. 16, as a function of frequency. The figure shows the binaural beamformer responses based on circuits including Omni-directional microphones (dashed-line) and End-Fire microphones (solid-line) at each side of the head. When End-Fire arrays are employed the system provides more than 10 dB 2×DI(ω) gain at frequencies above 1 kHz. The 2×DI(ω) gain decreases to an average of 8 dB in the low frequencies.

$$DI(\omega) = 10\cdot\log\left[\frac{P(\omega,\theta=0°)}{\frac{1}{71}\sum_{\theta=5}^{355}P(\omega,\theta)}\right] \quad \text{Eq. 16}$$

Figure 5:
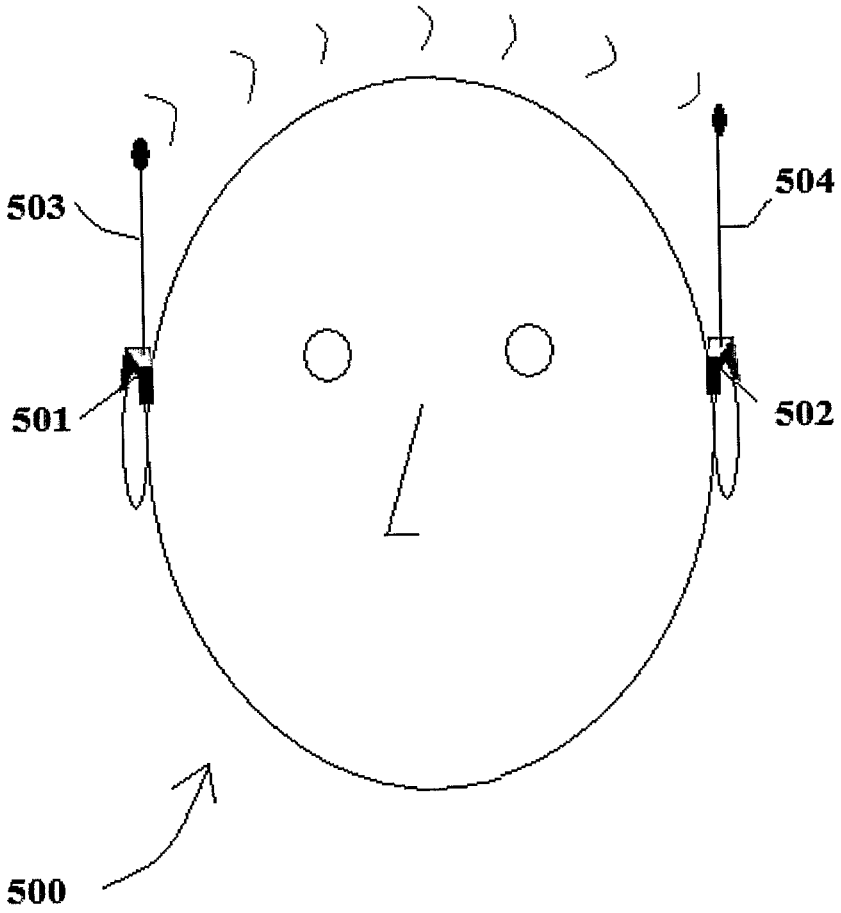
FIG. 5 is an illustration of an embodiment of the present invention based on wireless connection between left and right sides of the head.

Now referring to FIG. 5, 500, it depicts an application comprising of two hearing aids 501, 502 linked by a wireless connection 503, 504.

Figure 6:
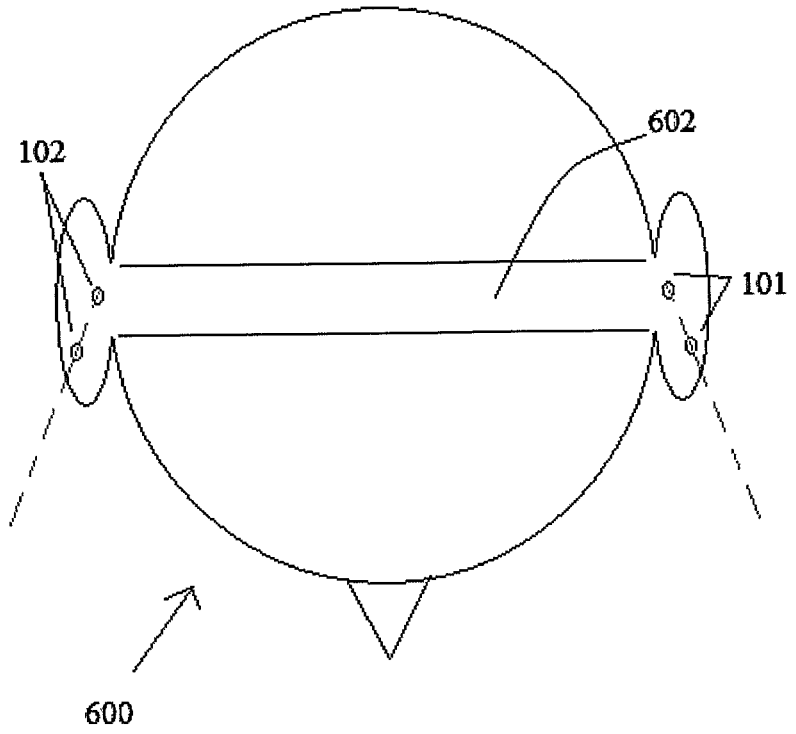
FIG. 6 is an illustration of an embodiment of the present invention based on directional microphones pointed away from the center of the head or arbitrarily positioned in free space.

Now referring to FIG. 6, 600, it depicts an optional extension to the embodiment whereby the microphones are positioned on a headphone 602, at a distance way from the head or in free space. As a result, the head does not provide a large interaural level difference. To account for this, independent directional microphones 102 and 101 operating on each side of the head are designed to have maximum directionality away from the medial region of the head. That is to say, the direction of maximum sensitivity of the left and right directional microphones or microphone arrays is directed to the left and right of the frontal direction, respectively, optionally to a degree greater than that which results from the combination of head diffraction and microphones physically aligned such that the axis connecting their sound entry ports is in the frontal direction. The outputs from these microphone arrangements are used in Eq. 1. and Eq. 2. and subsequent equations to produce directional filters. It should be obvious to those skilled in the art that hearing aids, earmuffs, hearing protectors and cochlear implants are just examples of the field of applications.

As explained above, embodiments of the invention produce a single channel output signal that is focused in a desired direction. This single channel signal includes sounds detected at both the left and right microphones. At the time of reproducing the signal for presentation to the auditory system of a user, the directional signal is used to prepare left and right channels, with localisation cues being inserted according to head-related transfer functions to enable a user to perceive an apparent direction of the sound.

Since numerous modification and changes will readily occur to those skilled in the art, it is not desired to limit the invention as illustrated and described. Hence, suitable modifications and equivalents may be resorted to as falling within the scope of the invention.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A method of producing a directional output signal including the steps of:

detecting sounds at the left and rights sides of a person's head to produce left and right signals;

determining the similarity of the signals on each side of the head to determine left and right directional filter weights, wherein determining left and right directional filter weights comprises either comparing the left and right signals' cross-power and auto-power by adding the cross-power to the auto-power and dividing the cross-power by the result, or comparing the left and right signals' cross-correlation and auto-correlation by adding the cross-correlation to the auto-correlation and dividing the cross-correlation by the result;

modifying both the left and right signals by way of a filter block using the left and right directional filter weights respectively; and combining the modified left and right signals to produce an output signal.

2. A method according to claim 1 further including the step of processing the right or left signals prior to determining their similarity to thereby control the direction of the directional output signal.

3. A method according to claim 2 wherein the step of processing includes the step of applying an inverse head-related transfer function.

4. A method according to claim 1 wherein the step of detecting sounds at the left and right sides of the head is carried out using directional microphones, or directional microphone arrays.

5. A method according to claim 4 wherein the direction of the left and right directional microphones or microphone arrays is directed outwardly from the frontal direction.

6. A method according to claim 1 wherein the degree of modification that takes place during the step of modifying is smoothed over time.

7. A method according to claim 1 wherein the step of modifying further includes the step of further enhancing the similarities between the signals.

8. A system for producing a directional output signal including: detection devices for detecting sounds at the left and rights sides of a person's head to produce left and right signals;

a determination device determining the similarity of the signals;

a modifying device for modifying the signals based on their similarity; and a combining device for combining the modified left and right signals to produce an output signal;

wherein the determination device is arranged to determine the similarity of the signals on each side of the head to determine left and right directional filter weights, wherein determining left and right directional filter weights comprises either comparing the left and right signals' cross-power and auto-power by adding the cross-power to the auto-power and dividing the cross-power by the result, or by comparing the left and right signals' cross-correlation and auto-correlation by adding the cross-correlation to the auto-correlation and dividing the cross-correlation by the result; and wherein the modifying device includes a filter block which is arranged to both the left and right signals by way of the filter block using the left and right directional filter weights respectively.

9. A system according to claim 8 wherein each detection device includes at least one microphone.

10. A system according to claim 8 wherein the determination device includes a computing device.

* * * * *